United States Patent [19]

Uys Naude

[11] 4,229,893

[45] Oct. 28, 1980

[54] FLUID DISPENSING APPARATUS AND DISPLAY MEANS

[75] Inventor: Thomas F. Uys Naude, Capetown, South Africa

[73] Assignee: Optic Ads (Pty.) Limited, Capetown, South Africa

[21] Appl. No.: 945,818

[22] Filed: Sep. 26, 1978

[30] Foreign Application Priority Data

Sep. 29, 1977 [ZA] South Africa ..... 77/5204

[51] Int. Cl.[3] ..... G09F 23/04

[52] U.S. Cl. ..... 40/332; 40/463

[58] Field of Search ..... 40/322, 427, 455, 332, 40/902, 463; 222/192, 185, 39

[56] References Cited

U.S. PATENT DOCUMENTS

| | | | |
|---|---|---|---|
| 1,276,271 | 8/1918 | Rossignol | 222/192 |
| 1,512,957 | 10/1924 | Traver | 40/455 X |
| 2,034,420 | 3/1936 | Reiland et al. | 40/332 |
| 2,196,356 | 4/1940 | De Sipio et al. | 222/192 |
| 2,521,449 | 9/1950 | Cossa | 40/902 |

*Primary Examiner*—Louis G. Mancene
*Assistant Examiner*—Wenceslao J. Contreras
*Attorney, Agent, or Firm*—J. Harold Nissen

[57] ABSTRACT

Advertising apparatus with electrically operated attention drawing means conveniently in the form of a lamp or device for emitting an audio signal. The apparatus is for use with a device for dispensing liquids from inverted bottles and has a support bracket, a resilient mounting projecting from the bracket and adapted to locate a liquid metering device and a bottle attached thereto, and a switching circuit for operating the attention-drawing means with the switching circuit being closed by movement of the bottle on the resilient mounting when the liquid metering device is activated.

8 Claims, 1 Drawing Figure

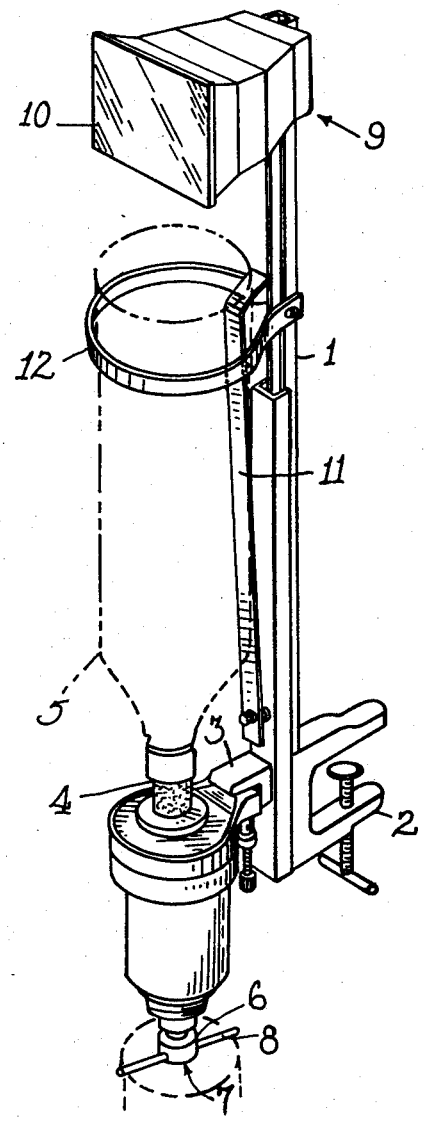
10
9
12
1
11
5
3
4
2
6
8
7

FLUID DISPENSING APPARATUS AND DISPLAY MEANS

This invention relates to advertising apparatus forming part of a device for dispensing liquids from bottles removably mounted on the device.

Dispensing devices of this type are well known and are often found in bars where liquor is sold. A bottle of spirits is supported upside down and has a metering device located in the opening thereof. This metering device, commonly known as a tot measurer, is often operated by pushing a glass up against an operating bar which is forced upwards, thus operating the measurer and metering the desired amount of liquid into the glass.

Generally the label of the bottle is directed forwardly to show to the customer what liquor, or brand thereof, he is purchasing. Because the bottle is upside down this is not very effective and furthermore does not serve to display the brand name to its best advantage. This is, of course, very important to persons trading in the liquor as they wish to obtain maximum advertisement of their product.

An object of this invention is thus to provide advertising apparatus for use in the advertisement of products sold in the above mentioned manner.

According to the invention advertising apparatus for use with a device for dispensing liquids from inverted bottles comprise:

- a support bracker;
- a resilient mounting projecting from the bracket and adapted to locate a liquid metering device and a bottle attached thereto;
- electrically operated attention-drawing means; and
- a switching circuit for operating the attention-drawing means said switching circuit being closed by movement of the bottle on the resilient mounting when the liquid metering device is activated.

The attention-drawing means may be either in the form of a device for emitting an audio signal or a lamp or a combination of these. Where a lamp is used this forms part of a visul advertisement and the lamp serves to illuminate this advertisement.

A preferred embodiment of the invention, described by way of example only, follows with reference to the accompanying drawing which represents a liquor dispensing device.

In this embodiment advertising apparatus will be described in conjunction with a liquor dispensing device of which it forms part.

The liquor dispensing device comprises an elongated metal member 1 to one end of which is fitted a clamp 2 suitable for clamping the device in an upstanding orientation to a shelf or other similar support.

On the opposite side of the clamp 1 is small clamp 3 which locates a mounting 12 of resilient material. This mounting locates a removable tot measurer 13 incorporating a suitable valve. The tot measurer includes an inlet 4 for sealing co-operation with a liquor bottle 5 or the like and an oppositely directed outlet 6 and valve activator 7; the latter including a transverse activating bar 8.

At the second end of the elongated member is a display 9 which consists of a plastics housing and a forwardly directed translucent screen 10 bearing advertising material. Behind the screen 10 is a lamp which is powered either by batteries or a suitable mains supply. A switching circuit for the lamp includes a switch in the form of an elongated spring metal strip 11 mounted in an insulated manner at a point adjacent the small clamp 3. The strip 11 projects away from the elongated member at a small acute angle and then bends towards the member at its free end 14, with the extremity terminating a short distance from the member 1. By contacting the member 1 with the free end of the strip 11 the switching circuit is closed and the lamp illuminated.

At its point furthest removed from the member 1 the strip is adapted to contact the side of a liquor bottle lying along the length of the member with its opening sealingly attached to the inlet 4 and further supported by a support ring 12 on the elongated member just below the display.

Thus, in use, the liquor dispensing device is mounted by the clamp 2 to a support as described. The tot measurer is removed from the small clamp, the inlet inserted into a bottle of liquor and this bottle then inverted into the support ring and the measurer reclamped in position.

To draw a tot from the bottle, a glass is urged upwardly against the transverse bar of the valve activator thus opening the valve. The upward thrust on the measurer causes its resilient mounting to bend slightly and hence the remote end of the bottle moves the strip 11 towards the elongated member. When the strip contacts the elongated member the switching circuit for the display is closed and the screen is illuminated by the lamp. As soon as the thrust is removed from the bar the bottle returns to its original position and the light goes out.

There are many forms which the switching circuit may take but this is simply a feature of the apparatus and its design. Furthermore, it should be noted that the switching circuit may activate an audio signal, such as a bell, in addition or alternatively to, the lamp of the illuminated display.

What we claim as new and desire to secure by Letters Patent is:

1. Advertising apparatus for use with a device for dispensing liquids from inverted bottles comprising:

- a support bracket;
- a resilient mounting projecting from the bracket and adapted to locate a liquid metering device and a bottle attached thereto;
- electrically operated attention-drawing means; and
- a switching circuit for operating the attention-drawing means said switching circuit being closed by movement of the bottle on the resilient mounting when the liquid metering device is activated.

2. Advertising apparatus as claimed in claim 1 in which the attention-drawing means is in the form of a device for emitting an audio signal.

3. Advertising apparatus as claimed in claim 1 in which the attention-drawing means is a lamp.

4. Advertising apparatus as claimed in claim 3 in which the lamp forms part of a visual advertisement and illuminates the advertisement when activated.

5. Advertising apparatus as claimed in claim 1, wherein said switching circuit includes a spring metal strip insulatingly mounted on said support bracket having a portion thereof in contact with the bottle.

6. Advertising apparatus as claimed in claim 6, wherein

- said spring metal is pivotally connected with said support bracket, and
- said switching circuit includes circuit contact means in circuit with said attention-drawing means for closing the circuit to said attention-drawing means upon movement of the bottle to pivot said spring metal into contact with said circuit contact means.

7. Advertising apparatus as claimed in claim 5 or 6, wherein said spring metal projects away from said support bracket at an acute angle and has a free end which bends towards said support bracket, the extremity of said free end terminating a short distance from said support bracket.

8. Advertising apparatus as claimed in claim 7, wherein said spring metal has an intermediate portion which is adapted to be in contact with the side of the inverted bottle and is substantially aligned with said support bracket.

* * * * *